US005606641A

United States Patent [19]

Bucaille

[11] Patent Number: 5,606,641

[45] Date of Patent: Feb. 25, 1997

[54] DEVICE FOR THERMAL REGULATION OF A CIRCULATING FLUID COMPRISING A STACKED CORRUGATED PLATE HEAT EXCHANGER WITH HEAT TRANSFER AND COOLING PATHS AND ELECTRICAL HEATING ELEMENT THEREBETWEEN

[76] Inventor: Joël Bucaille, 12 rue de la Croix Blanche, 27120 Jouy Sur Eure, France

[21] Appl. No.: 522,854

[22] Filed: Sep. 1, 1995

Related U.S. Application Data

[63] Continuation of Ser. No. 146,055, filed as PCT/FR93/00304 published as WO93/20389 Oct. 14, 1993, abandoned.

[51] Int. Cl.[6] ..... F24H 1/12; F28F 27/00; F28F 3/08; G05D 23/19

[52] U.S. Cl. ..... 392/495; 392/496; 165/166; 165/58; 165/DIG. 356; 165/DIG. 367

[58] Field of Search ..... 392/484, 495, 392/496; 165/166, 167, 58, DIG. 356, DIG. 367, DIG. 372, DIG. 393, DIG. 394, DIG. 396, DIG. 505

[56] References Cited

U.S. PATENT DOCUMENTS 2,852,232 9/1958 Marwell .

5,462,113 10/1995 Wand ..... 165/167

FOREIGN PATENT DOCUMENTS

| | | |
|---|---|---|
| 2209918 | 7/1974 | France . |
| 2404985 | 9/1978 | France . |
| 2658332 | 8/1991 | France . |
| 204112 | 3/1978 | Germany . |
| 3324901 | 1/1985 | Germany . |
| 3344650 | 2/1985 | Germany . |

*Primary Examiner*—John A. Jeffery
*Attorney, Agent, or Firm*—Harris Beach & Wilcox, LLP

[57] ABSTRACT

A device for the thermal regulation of a pressurized circulating fluid includes a plurality of elementary assemblies, each formed by a stack of ribbed or corrugated plates. Seals define fluid circulation circuits for conducting coolant fluid and heat transfer fluid therethrough, the circuits emerging at the top and the bottom of the device, heat being exchanged between the circuits through the plates. An electrical heating resistance element is interposed between the circuits for precise thermoregulation of the heat transfer fluid.

6 Claims, 3 Drawing Sheets

DEVICE FOR THERMAL REGULATION OF A CIRCULATING FLUID COMPRISING A STACKED CORRUGATED PLATE HEAT EXCHANGER WITH HEAT TRANSFER AND COOLING PATHS AND ELECTRICAL HEATING ELEMENT THEREBETWEEN

This application is a continuation of U.S. patent application Ser. No. 08/146,055, field Nov. 2, 1993, now abandoned, and claims the priority of prior international application of PCT/FR 93/00304 filed Mar. 26, 1993.

BACKGROUND OF THE INVENTION

1. Field of the Invention

The subject of the present invention is a device for thermal regulation of a circulating fluid, used especially to regulate the temperature of tooling or of reactors.

2. Description of the Prior Art

Such devices, intended to regulate the temperature of tooling for molding plastics, by means of a heat-transfer fluid circulating under the action of a pump already exist. In these devices, the temperature of the fluid can be increased by means of electrical heating resistance elements or decreased by means of second, cold fluid passing through an exchanger, the whole assembly being able to be controlled by means of an electronic regulator connected to one or more thermocouples judiciously arranged in the path of the heat-transfer fluid and by various safety devices.

In general, these devices include a heater-cooler of the heat-transfer fluid formed by a storage tank inside which is arranged an electrical heating resistance element and a cooling fluid circuit consisting of a coil, the electrical resistance elements being, of course, arranged inside an shielded tube, as described in document BF-A. 2,658,332 (VULCANIC SA).

In order to cool the heat-transfer fluid, other regulation devices include a plate exchanger. In these well-known exchangers, consisting of a stack of plates, the fluid to be cooled and the cold fluid circulate in two different circuits without contact with each other, on either side of each plate. The regulation devices, including such plate exchangers, are bulky since the heating resistance elements obviously have to be outside and some distance away from the said heat exchangers, whence the whole assembly forms a significant volume and has to have a large quantity of heat-transfer fluid circulating.

However, plate exchangers exist which include an electrical heating resistance element inserted between the plates, as described in Canadian Patent 979,059. These constructions do not make it possible to produce a thermoregulation device allowing the passage of several fluids which are to circulate vertically and alternately between the plates in order to emerge at the top and at the bottom of the device while at the same time being perfectly sealed.

In addition, with existing devices, a precise temperature with a very short response time cannot be obtained.

SUMMARY OF THE INVENTION

The object of the present invention is to overcome these drawbacks by the construction of a device for the temperature regulation of a fluid by means of a heat exchanger, consisting of a stack of undulated or ribbed plates defining, by means of seals arranged between the said plates, alternate coolant fluid and heat-transfer fluid circuits.

The device according to the invention is especially characterized in that the aforementioned stack is formed by a plurality of elementary assemblies each comprising, in order:

One coolant fluid circuit

Two heat-transfer fluid circuits

Another coolant fluid circuit and in that, an electrical heating resistance element is interposed between the two heat-transfer fluid circuits.

Another characteristic of the invention resides in that the electrical resistance element is embedded in a suitable material, for example ceramic, which is electrically insulating but heat conducting and which is shaped in an identical manner to the ribbed plates so a to be inserted without difficulty between the said plates.

Another characteristic of the invention resides in that the electrically insulated electrical resistance element can be embedded in a conducting material, such as aluminum, the walls of which match the undulated shape of the usual plates, which allows them to be omitted.

Another characteristic of the invention resides in that the alternate coolant-fluid and heat-transfer fluid circuits are defined by means of seals having a sufficient thickness for them to be compressed between two ribbed plates.

The coolant- and heat-transfer fluid circuits circulate in the stack of the ribbed plates by means of inlet and outlet orifices made in the said plates so that the fluids pass through them perpendicularly to their plane.

The regulation device according to the invention is compact while at the same time having a large heat-exchange surface area and requires only a small volume of heat-transfer fluid, generally water or oil. Furthermore, it makes it possible to have a very short response time, the fluid being raised rapidly to the desired temperature.

The fluid thus regulated can be especially a circuit of heat-transfer liquid set into circulation by a pump and serving to regulate the temperature of tooling or of reactors, for example from 5° to 250° C.

Depending on the regulation and flow rate which are envisaged, an exchanger is constructed which includes a stack of a fairly large number of plates between which are inserted a fairly large number of heating plates.

BRIEF DESCRIPTION OF THE DRAWING

The invention will be better understood by reading the description which follows of one of its preferred embodiments and by examining the appended drawings in which.

DESCRIPTION OF THE PREFERRED EMBODIMENT

Figure 1:
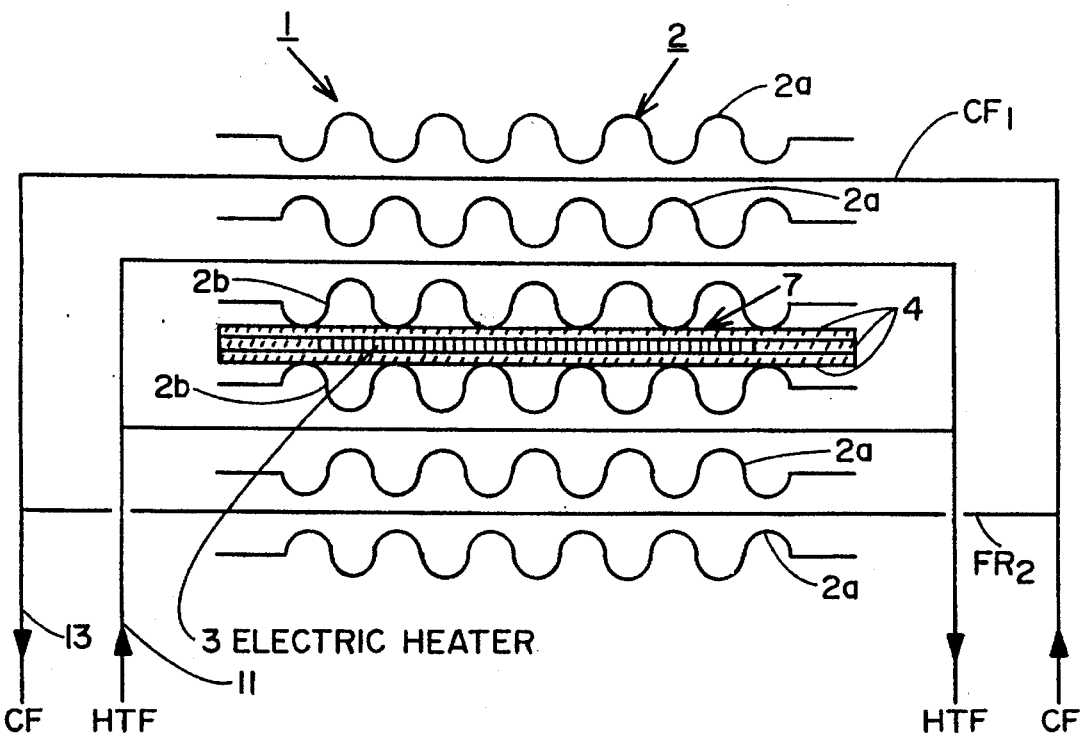
FIG. 1 is a diagrammatic view of the regulation device according to the invention.

Referring to FIG. 1, which is a schematic diagram of a basic element intended to constitute the temperature regulation device according to the invention, it is seen that it is formed of a stack 1 of corrugated or ribbed plates 2, of a type which is known for this application, for example made from stainless steel. These plates define, by means of seals which are not shown but are conventional, alternate heat-transfer fluid (HTF) and coolant fluid (CF) circuits 11–13.

This basic element comprises ribbed plates 2*a* between which pass, in order:

One coolant fluid (CF1) circuit

Two heat-transfer fluid (HTF1 and HTF2) circuits

A second coolant fluid (CF2) circuit. Between the two heat-transfer fluid (HTF1 and HTF2) circuits is interposed, between the plates 2*b*, a heating means 7 consisting of an electrical resistance element 3 arranged between the plates 4 made of refractory material (ceramic).

In a simplified variant, the electrically insulated electrical resistance element (3) can be embedded in a conducting filling material, such as aluminum, the walls of which match the undulated shape of the usual plates which advantageously allows them to be omitted and hence produces a substantial saving.

In a stack of plates 2, it is possible, for example, to arrange three electrical resistance elements connected up to a three-phase source or to mount them in parallel. By acting either on the flow rate of the cooling fluid or on the heating resistance element, the desired temperature of the heat-transfer fluid (HTF) is obtained.

Figure 2:
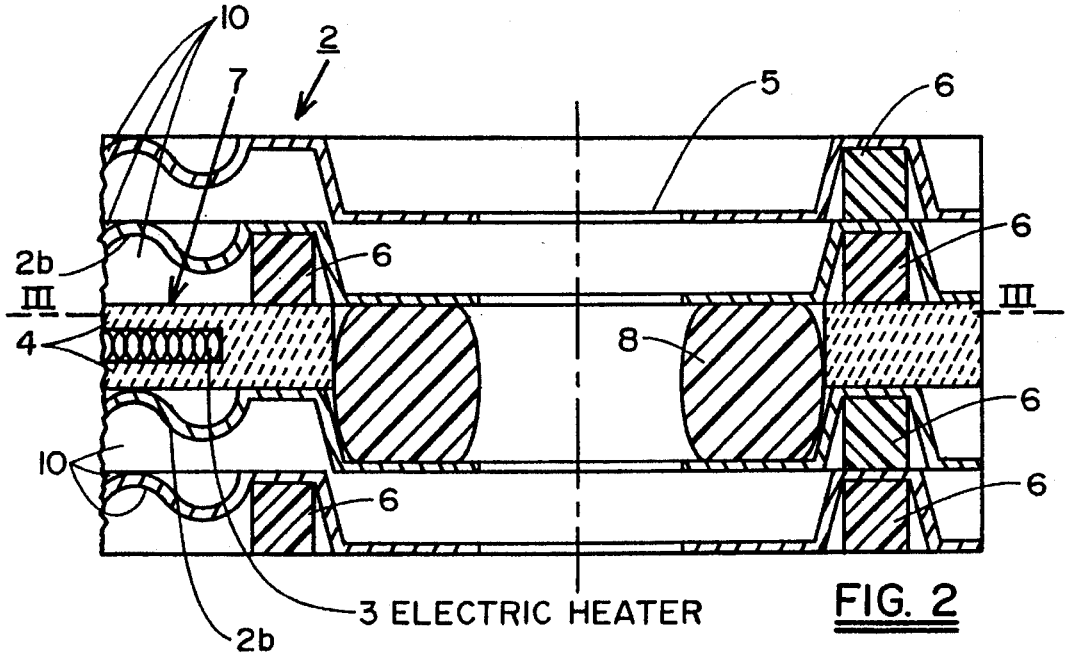
FIG. 2 is a partial diagrammatic view showing the integration of a heating plate between the plates of an exchanger according to the invention.

Part of the stack of plate [sic] 2 forming the exchanger of the device according to the invention has been represented diagrammatically in FIG. 2.

This exchanger is formed by the stack of a certain number of plates 2 having, in a known manner, volutes or undulations 10 in order to force the circulating fluid to create turbulence; these plates 2 are equipped with orifices 5 at each end in order to allow the entry into and exit from their respective cavity of the heat-transfer fluid (HTF) and of the cooling fluid (CF). Between these plates 2, and on their perimeter, are arranged seals 6, of known type, whose purpose is to provide sealing between each plate 2 and also around the fluid-inlet and -outlet orifices 5 in the said stacked plates. So that the fluids can circulate between two plates 2, the seal 6 is divided up around the orifice 5 every second time, as seen in FIG. 2.

According to another characteristic of the invention, a heating means 7, which can be constituted by one or more electrical resistance elements 3, arranged in a refractory material in the form of a plate 4, is arranged between the plates 2, all the resistance elements being connected to an electrical source, not represented.

So that perfect sealing is provided, a seal 8 of circular cross section is arranged around the orifice 5 where the fluid circulates. This seal 8 can have any cross section, but its thickness has to be greater than the thickness of the heating plate 4 plus the distance separating two plates 2, so that, upon mounting, it is compressed and thus provides perfect sealing. It must also be made of a material which can withstand the maximum envisaged temperature.

The cells 10 formed above and below the heating element 7 may be filled with a refractory cement or with a similar good heat-conducting material. Two insulating plates, held in place in the conventional way by ties, are arranged above and below the stack of the plates of the exchanger.

Figure 3:
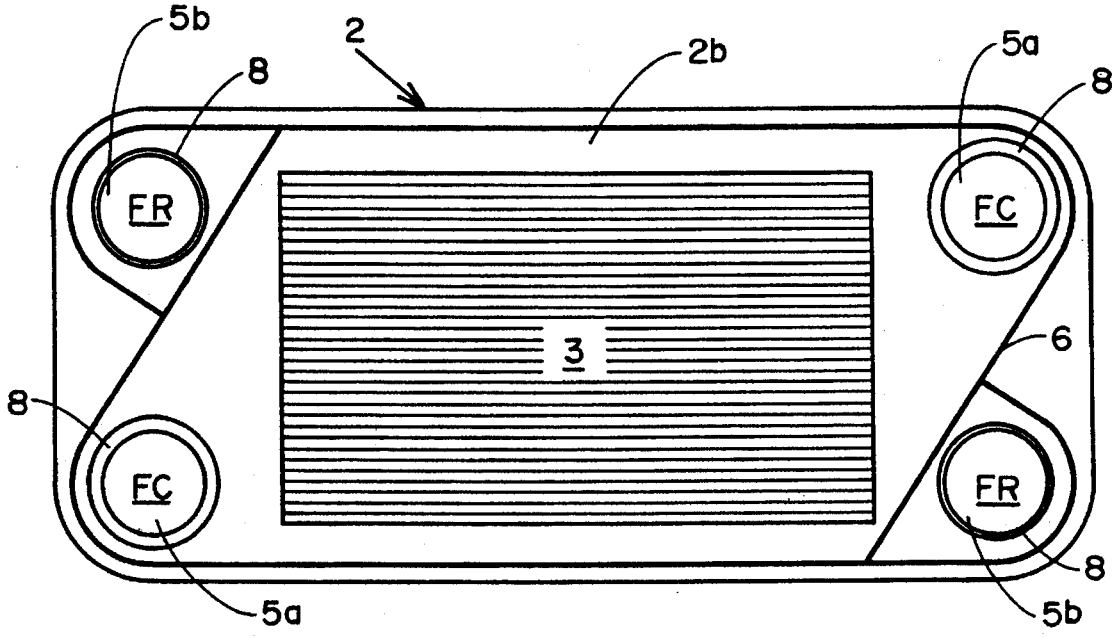
FIG. 3 is a plan view of an exchanger plate with heating plate along the line III—III of FIG. 2.

A plan view of the plates 2 along the line III—III of FIG. 2 has been represented in FIG. 3, showing the orifices 5*a* for passage of the heat-transfer fluid (HTF) and those 5*b* for the cooling fluid (CF) as well as the position of the seals 8 and 6, the central hatched area represents the position of the heating resistance element 3. As may be seen, the active portion of the heating elements lies below the seal 6.

Figure 4:
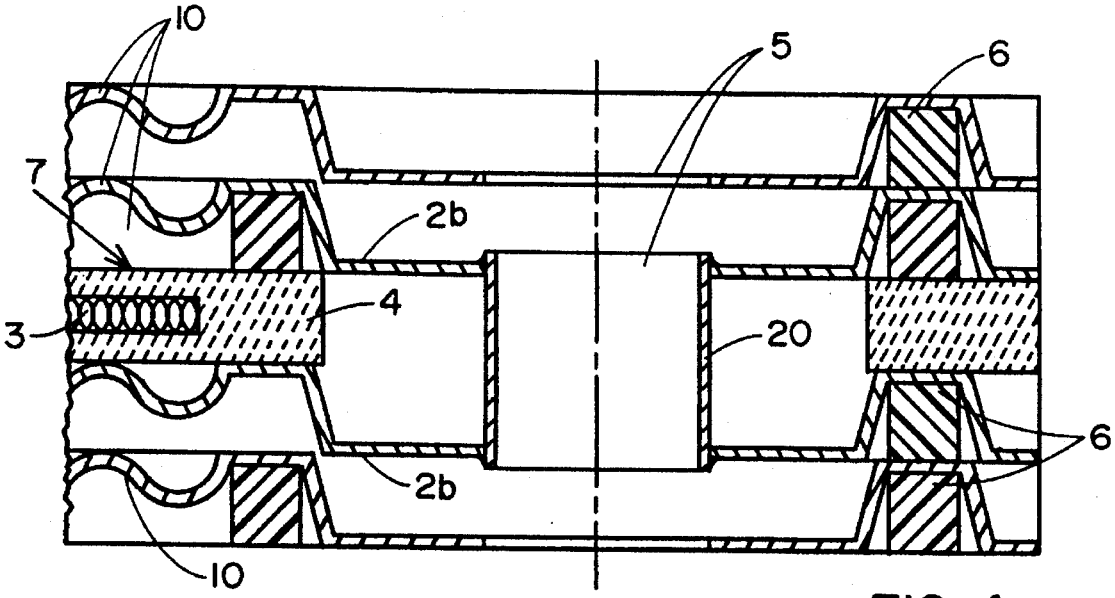
FIGS. 4 & 5 are views, in partial section, of a stack of plates with a fluid circulation orifice.
Figure 5:
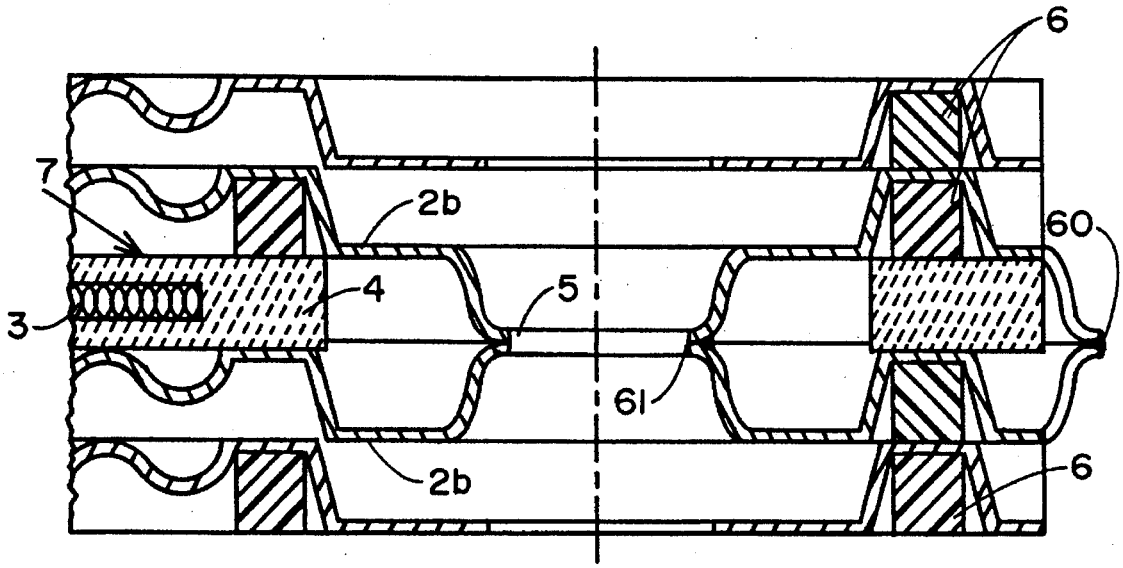

Two embodiment variants, showing the stack of plates 2 forming the exchanger of the device according to the invention, have been represented in FIGS. 4 and 5 in which the seal 8 of the embodiment of FIG. 2 has been omitted and replaced by a metal sleeve 20 welded to the plates 2*b* so that perfect sealing is provided (FIG. 4).

In the second variant, shown in FIG. 5, the plates 2*b* have been shaped so that they can be welded at 61 around the opening 5 for the passage of the fluid 3 and at their periphery 60.

Figure 6:
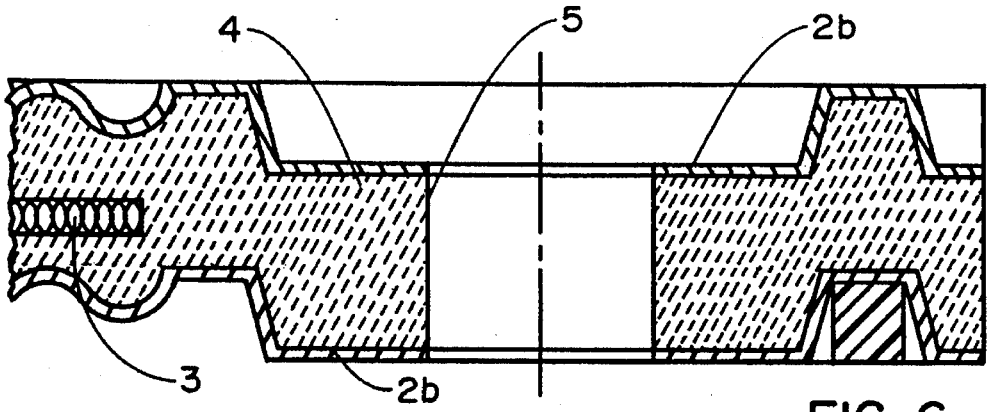
FIG. 6 is a partial sectional view of a heating resistance element with the same configuration as the ribbed plates.

Another variant has been represented in FIG. 6, in which the electrical resistance element 3 is embedded in a ceramic material 4, for example a ceramic which is insulating but a good heat conductor, which is shaped in a manner identical to the ribbed plates 2*b* so as to be inserted without difficulty between the said plates. An orifice 5 is provided for the passage of the fluid. This embodiment allows the seal 8 to be omitted.

Figure 7:
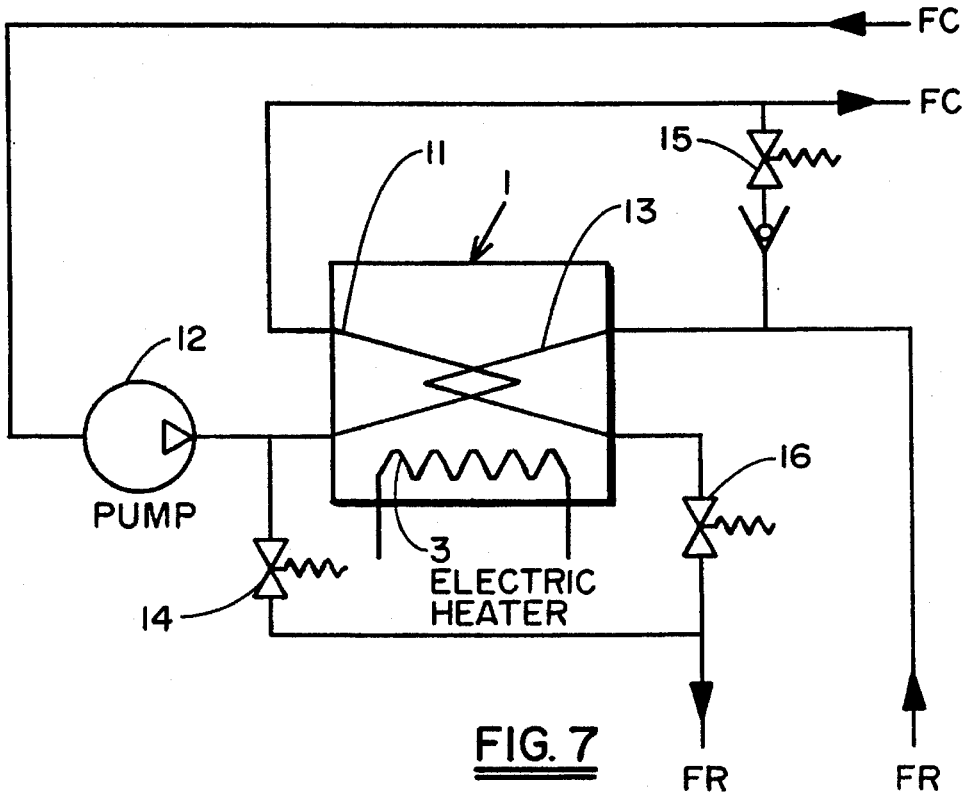
FIG. 7 is a diagram of a temperature regulation device according to the invention.

FIG. 7 is a diagram of the temperature regulation device according to the invention. As can be seen in this figure, the device according to the invention is very simple. It includes a plate exchanger 1 with its electrical heating resistance element or elements 3, the said exchanger being traversed, on the one hand, by a circuit 11 for heat-transfer fluid (HTF) in a circulation forced by means of a pump 12 as a far as a mold of an injection press or as far as a reactor of an item of equipment, not represented, and, on the other hand, by a cold-water circuit 13. The heat-transfer fluid circulates from the plate exchanger 1 to the tooling in a closed circuit and without an intermediate storage tank.

Three solenoid valves 14, 15 and 16 are provided in order to isolate the heat-transfer fluid (HTF) and to limit losses in the closed circuit 11 which goes to the mold or the reactor.

Of course, in the device according to the invention there is also provided a device for continuously measuring temperature in the exchanger, the said device being connected to a regulation system of a known type which enables the temperature of the heat-transfer fluid inside the exchanger to be read continuously and for it to be limited to a maximum temperature. This device may provide, as appropriate, the regulation of the temperature if the mold or the reactor does not include a temperature probe.

Of course, the device according to the present invention can be used not only for the regulation of the temperature of molds of injection presses but also of extruder barrels and screws, of reactors used in the chemical industry and as a complement for heat, solar-heating or geothermal pumps.

The thermal regulation device according to the invention has an advantageous cost price. Moreover, it can easily be dismantled since the various elements which constitute it can rapidly be replaced or modified and it allows ease of maintenance since there is access to the surfaces, therefore allowing them to be cleaned; moreover, it is compact and possesses a short response time.

I claim:

1. A device, adapted for use with a source of cooling liquid and a source of electrical energy, for regulating the temperature of a fluid, said device comprising at least one elementary assembly, each elementary assembly, including, in combination:

a plurality of ribbed plates joined together into a stack;

a plurality of seals;

said ribbed plates and seals together defining a first circulation circuit for conducting a flow of said cooling liquid, said first circulation circuit being divided into two parallel sub-circuits each bounded by two ribbed plates;

said ribbed plates and seals also together defining a second circulation circuit for conducting a flow of said fluid, said second circulation being divided into two parallel sub-circuits each bounded by two ribbed plates;

an electrical heating element thermally coupled to both of the sub-circuits of said second circulation circuit, said heating element being positioned between two of the ribbed plates which bound the sub-circuits of said second circulation circuit;

each of the sub-circuits of said first circulation circuit being thermally coupled to a respective one of the sub-circuits of said second circulation circuit through one of the ribbed plates which bound that respective sub-circuit;

whereby said fluid may absorb heat from said electric heating element and deliver heat to said source of cooling liquid as necessary for the temperature regulation thereof.

2. The device of claim 1 in which said ribbed plates have orifices for the passage of cooling liquid between the two sub-circuits of said first circulation circuit, and sealing means for preventing cooling liquid flowing through said first circuit from mixing with fluid flowing through said second circuit.

3. The device of claim 2 further including a pump in said second circuit for providing forced circulation of fluid through said second circuit, said heating element delivering a regulated quantity of thermal energy to said fluid whereby a desired temperature of said fluid is achieved.

4. The device of claim 2 further including a body of thermally conducting material disposed between said heating element and said two ribbed plates to increase the rate at which heat may be transferred to the sub-circuits of said second circulation circuit.

5. The device of claim 1 further including a pump in said second circuit for providing forced circulation of fluid through said second circuit, said heating element delivering a regulated quantity of thermal energy to said fluid whereby a desired temperature of said fluid is achieved.

6. The device of claim 1 further including a body of thermally conducting material disposed between said heating element and said two ribbed plates to increase the rate at which heat may be transferred to the sub-circuits of said second circulation circuit.

* * * * *